US006407623B1

(12) United States Patent
Bazarjani et al.

(10) Patent No.: US 6,407,623 B1
(45) Date of Patent: Jun. 18, 2002

(54) BIAS CIRCUIT FOR MAINTAINING A CONSTANT VALUE OF TRANSCONDUCTANCE DIVIDED BY LOAD CAPACITANCE

(75) Inventors: Seyfollah Bazarjani; Jeremy Goldblatt, both of San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/773,404

(22) Filed: Jan. 31, 2001

(51) Int. Cl.[7] ..... G05F 1/10; G05F 3/02
(52) U.S. Cl. ..... 327/541; 327/96; 327/337
(58) Field of Search ..... 327/334, 337, 327/532, 538, 540, 541, 543, 91, 94, 96; 323/313, 315

(56) References Cited

U.S. PATENT DOCUMENTS 4,864,217 A * 9/1989 Bird ..... 323/316
6,232,725 B1 * 5/2001 Derra et al. ..... 315/209 R
6,300,805 B1 * 10/2001 Daffron et al. ..... 327/108

* cited by examiner

*Primary Examiner*—Terry D. Cunningham
*Assistant Examiner*—Quan Tra

(74) *Attorney, Agent, or Firm*—Philip R. Wadsworth; Charles D. Brown; George C. Poppas

(57) ABSTRACT

A bias circuit is described for use in biasing an operational amplifier to maintain a constant transconductance divided by load capacitance (i.e. a constant $g_m/C_L$) despite temperature and process variations and despite body effects. In one example, the bias circuit includes a pair of current source devices and a switched capacitor (SC) equivalent resistor circuit for developing an equivalent resistance between the current source devices. The equivalent resistor circuit includes a sampling capacitor. First and second clock inputs are connected to the capacitor providing non-overlapping clock signals at a predetermined sampling frequency to establish a resistance equivalent. By providing an SC equivalent resistor circuit clocked by non-overlapping fixed clock signals, the $g_m/C_L$ of the bias circuit is maintained substantially constant. Hence, a fixed bandwidth is maintained within the operational amplifier being biased. When employed in connection with operational amplifiers of an SC circuit, the constant bandwidth enables the SC circuit to operate at a constant switching speed despite temp and process variations. Furthermore, by positioning the resistance equivalent circuit between the current source devices of the bias circuit, voltage differentials between the sources are eliminated thereby removing any threshold voltage mismatch and thus compensating for body effect variations. Other bias circuit examples are also described including a stray insensitive bias circuit and a bias circuit employing three mutually non-overlapping clock signals.

20 Claims, 7 Drawing Sheets

BIAS CIRCUIT FOR MAINTAINING A CONSTANT VALUE OF TRANSCONDUCTANCE DIVIDED BY LOAD CAPACITANCE

BACKGROUND OF THE INVENTION

1. Field of the Invention

The invention generally relates to integrated circuits and in particular to CMOS bias circuits for biasing operational amplifiers of switched capacitor (SC) circuits or other devices employing NMOS or PMOS differential pairs.

2. Description of the Related Art

Operational amplifiers containing differential pairs are commonly employed within integrated circuits as components of, for example, SC analog signal processing circuits. Bias circuits are employed in connection with the differential pairs of the operational amplifiers to ensure that certain characteristics of the operational amplifier remain substantially constant despite temperature changes or process variations. Examples include bias circuits for maintaining a constant current or a constant transconductance ($g_m$) within the differential pair of the operational amplifier. A constant $g_m$ is more efficient than constant current. For operational amplifiers used in SC circuits, the operational speed of the SC circuit is limited primarily by the unity gain bandwidth of the operational amplifiers. More specifically, the settling time of the SC circuit is a strong function of the unity gain bandwidth of the operational amplifiers wherein the unity gain bandwidth is given by $$\omega_0 = \frac{g_m}{C_L},$$

where $g_m$ is the transconductance of the operational amplifier and $C_L$ is the effective load capacitance.

Hence, bias circuits providing only a constant $g_m$ do not necessarily yield improved performance speed for SC circuits. Rather, a bias circuit providing a constant $g_m/C_L$ is preferred. In the following, various conventional bias circuits for use with operational amplifiers are described and unity gain bandwidth issues arising with respect to the bias circuits are discussed.

FIG. 1 illustrates an exemplary operational amplifier 10 appropriate for use in a SC circuit. Operational amplifier 10 includes a differential pair of NMOS devices 12 and 14 and a differential pair of PMOS current mirror devices 13 and 15. The four devices are interconnected, as shown, between a positive voltage source $V_{DD}$ and a node A. The pair of NMOS devices have gates connected to a pair of voltage input lines 16 and 18, respectively. An output line 20 is connected to a node interconnecting NMOS device 14 and PMOS device 15 as shown. A capacitor 21, providing a load capacitance of $C_L$, couples the output signal to an external load 22. To ensure that certain circuit characteristics such as current or $g_m$ remain constant despite temperature or process variations, the operational amplifier is biased by a bias signal provided along. a bias line 25 and applied to the gate of an additional NMOS device 24 connected between node A and ground.

FIG. 2 illustrates operational amplifier 10 of FIG. 1 in combination with a bias circuit 26 for maintaining constant current despite temperature changes and process variations. Bias circuit 26 includes a current source 27 in combination with a single NMOS device 29 configured to operate as a current mirror. With this arrangement, the operational amplifier is biased to maintain constant current proportional to the current provided by current source 27, independent of temperature changes and process variations.

However, the $g_m$ of the operational amplifier is not maintained as a constant. Rather the $g_m$ of the operational amplifier of FIG. 2 is given by:

$$g_m = \frac{2I_0}{v_{GS} - V_T},$$

where, $I_0$ is the bias current, $V_{GS}$ is the gate to source voltage of device 12, and $V_T$ is the threshold of device 12. $V_T$ changes with temperature and process variations. Thus $g_m$ varies due to temperature and process fluctuations. Moreover, for most applications, the load capacitance ($C_L$) also changes due to process variations by about ±10%. Therefore, the unity gain bandwidth of an operational amplifier biased with a constant current source can change significantly due to $g_m$ and $C_L$ variations caused by temperature changes and process fluctuations. Hence, the speed performance of an SC circuit employing the operational amplifier is degraded.

FIG. 3 illustrates operational amplifier 10 of FIG. 1 in combination with a bias circuit 30 for maintaining a constant $g_m$ despite temperature changes and process variations. Briefly, the bias circuit includes a pair of NMOS devices 32 and 34 connected between a pair of nodes B and C and ground, respectively. A pair of PMOS devices 33 and 35 are connected, respectively, between nodes B and C and a positive voltage source. Gates of NMOS devices 32 and 34 are connected to node B. Gates of PMOS devices 33 and 35 are connected to node C. A $g_m$-setting resistor 36 is connected between the source of NMOS device 34 and ground. Resistor 36 is typically located off-chip to permit the resistance to be set after chip fabrication. In use, bias circuit 30 operates as a current mirror to generate a bias current that sets the $g_m$'s of NMOS devices 12 and 14 of the operational amplifier to an amount inversely proportional to the resistance of $g_m$-setting resistor 36. The bias circuit is, in effect, an MOS version of a self-biasing Widlar current source, well known in the art.

Thus, the bias circuit of FIG. 3 substantially guarantees that the $g_m$ of the operational amplifier does not vary due to process and temperature variations, at least to the first order. More specifically, the Kirchoff voltage levels for the circuit are given by:

$$I_0R + v_{GS2} = v_{GS1}.$$

Assuming a quadratic equation for the drain saturation current:

$$v_{GS} - v_T = \sqrt{(Id) \Big/ \left(\frac{1}{2}\mu C_{OX}\frac{W}{L}\right)}.$$

If threshold voltages of devices 32 and 34 of the bias circuit are assumed to be equal (ignoring body effects) then:

$$v_{GS1} - V_T = 2(v_{GS} - V_T)$$

Hence:

$$I_0R=\tfrac{1}{2}(V_{GS1}-V_T)$$

and thus, $$g_m = \frac{2I_0}{v_{GS1} - V_T} = \frac{1}{R}.$$

Thus, disregarding body effects, the $g_m$'s of the devices of the operational amplifier are merely proportional to the resistance of $g_m$-setting resistor 36. Unfortunately, in practical integrated circuits, body effects can pose a significant problem. Briefly, body effects relate to a modification of the threshold voltage $V_T$ caused by a voltage difference between source and substrate. The change in voltage threshold is proportional to the square root of the voltage between the source and the substrate.

In the circuit of FIG. 3, the change in threshold voltage results in two separate problems. The first problem occurs from the variations in source voltage between NMOS devices 32 and 34 of the bias circuitry. Since the source of NMOS device 34 is at a different voltage from that of device 32, the $g_m$ is not merely proportional to the resistance of resistor 36 but is instead given by the following equation:

$$g_m = \frac{1 + \sqrt{1 + 2 \cdot B \cdot R \cdot vterr}}{2R}$$

where $$B = \mu_n Cox \frac{W}{L}.$$

This formula for $g_m$ may be derived from the following set of equations:

$$v_{gs1}=v_{gs2}+I\cdot R-v_{terr}$$

and since $$vgs = \sqrt{2 \cdot \frac{I}{B}} - v_{T0}$$

with $$B = \mu_n Cox \frac{W}{L}.$$

then $$\sqrt{2 \cdot \frac{I}{B}} = \frac{1}{2}\sqrt{2 \cdot \frac{I}{B}} + I \cdot R - vterr.$$

solving for $$\sqrt{I} = \frac{\frac{1}{\sqrt{2 \cdot B}} + \sqrt{\frac{2}{B} + R \cdot vterr}}{2R}$$

yields $$g_m=\sqrt{2\cdot B\cdot I}$$

and finally $$g_m = \frac{1 + \sqrt{1 + 2 \cdot B \cdot R \cdot vterr}}{2R}.$$

The second body effect problem occurs as a result of absolute differences between devices 32 and 34 of the bias circuitry and devices 12 and 14 of the operational amplifier. The absolute current generated in the bias circuit is proportional to the threshold voltage, and therefore any variances between the source voltages will result in a different $g_m$ value. Since the input common mode voltage to the operational amplifier is fixed, the source voltage of devices 12 and 14 will vary with process causing a non-tracking $g_m$. As a result, temperature changes and process variations are not fully compensated for by the CMOS bias circuitry of FIG. 1 resulting in variations in the $g_m$ of the operational amplifier. Hence, the unity gain bandwidth is again affected.

Co-pending U.S. patent application Ser. No. 09/283090, filed Mar. 31, 1999 describes an improved constant $g_m$ bias circuit which compensates for variations caused by body effects in addition to variations caused by temperature or process to provide a constant $g_m$. The co-pending application is entitled "Constant Transconductance Bias Circuit having Body Effect Cancellation Circuitry" of Jeremy Goldblatt and Seyfi Bazarjani. The co-pending application is incorporated by reference herein. However, as noted above, the speed performance of an SC circuit incorporating operational amplifiers is limited by the unity gain bandwidth of the operational amplifiers. Even with a bias circuit that provides constant $g_m$, the unity gain bandwidth may still vary as a result of changes in the load capacitance ($C_L$) of the bias circuit. Hence, it would be highly desirable to provide an improved bias circuit for use with operational amplifiers, or other devices employing an NMOS differential pair, that maintains a substantially constant $g_m/C_L$ despite temperature and process variations and also despite body effects and it is to that end that aspects of the invention are primarily directed.

SUMMARY OF THE INVENTION

In accordance with a first aspect of the invention, a bias circuit is provided for use in biasing a differential pair, such as an NMOS differential pair of an operational amplifier, to maintain a constant $g_m/C_L$ despite temperature and process variations. The bias circuit includes a pair of current source devices and a resistance equivalent circuit for developing an equivalent resistance between the current source devices. The resistance equivalent circuit includes a sampling capacitor connected between a sampling node connecting the pair of current source devices and a ground. A first clock input is connected between the sampling node and a first current source device and a second clock input is connected between the sampling node and a second current source device. The first and second clock inputs provide non-overlapping clock signals at a predetermined sampling frequency to establish a resistance equivalent. Voltage-setting circuitry is connected to the resistance equivalent circuit for applying a voltage across the circuit to cause the bias circuit to generate a bias signal. A bias line transmits the bias signal to the differential pair being biased.

By providing the bias circuit as described with a resistance equivalent circuit with non-overlapping clock signals at a predetermined frequency, the $g_m/C_L$ of the bias circuit is maintained substantially constant to thereby maintain a fixed bandwidth within the differential pair being biased. When employed in connection with operational amplifiers of an SC circuit, the constant bandwidth enables the SC circuit to operate at a constant switching speed in independent of temperature and process variations.

Furthermore, by positioning the resistance equivalent circuit between the current source devices of the bias circuit, voltage differentials between the source-drain of MOSFETs are eliminated thereby removing any threshold voltage mismatch. Hence, body effect variations that will affect the threshold voltage do not cause a significant change in the $g_m/C_L$ of the bias circuit. Source follower circuitry may also be provided to substantially eliminate any absolute differences between the source terminals of the current source devices of the bias circuit and sources of the differential pair thereby further reducing variations in $g_m/C_L$ caused by body effects.

In accordance with a second aspect of the invention, a stray insensitive bias circuit for use in biasing a differential pair is provided wherein a substantially constant $g_m/C_L$ is maintained and a bandwidth center frequency of the bias circuit does not drift. The bias circuit includes a pair of current source devices and a resistance equivalent circuit for developing an equivalent resistance between the current source devices. The equivalent circuit includes a capacitor connected between gates of first and second current source devices. A first clock input is connected between a first terminal of the capacitor and the gate of the first current source device and is also connected between a second terminal of the capacitor and the gate of the second current source device. A second clock input is connected between the first terminal of the capacitor and a ground and also connected between the second terminal of the capacitor and the ground. The first and second clock inputs provide non-overlapping clock signals at a predetermined sampling frequency to establish a resistance equivalent.

By providing two sets of clock signal inputs connected to the capacitor as described, a constant $g_m/C_L$ is maintained without significant drift. Voltage differentials between the source terminals of the current sources are also eliminated to thereby compensate for body effect variations. As with the first aspect of the invention, a pair of resistance equivalent circuits may be employed in parallel instead of just one to help eliminate parasitic capacitance effects that might otherwise affect the constant $g_m/C_L$ bias. Source follower circuitry may also be provided to substantially eliminate any absolute differences between the sources of the current source devices of the bias circuit and sources of the differential pair thereby further reducing variations in $g_m/C_L$ caused by body effects.

In accordance with a third aspect of the invention, another bias circuit for use in biasing a differential pair is provided to maintain a substantially constant $g_m/C_L$. The bias circuit includes a pair of current source devices and a capacitor. A first clock input is connected between a first terminal of the capacitor and a current output line output from the differential pair being biased. The first clock input is also connected between a second terminal of the capacitor and a common mode voltage input line. A second clock input is connected between the first terminal of the capacitor and a positive voltage reference line and is also connected between the second terminal of said capacitor and a negative voltage reference line. A third clock input is connected between the first terminal of said capacitor and a ground and also connected between the second terminal of said capacitor and said ground. The first, second and third clock inputs provide mutually non-overlapping clock signals at a predetermined sampling frequency to establish a resistance equivalent.

By providing three sets of clock signal inputs connected to the switching capacitor as described, a constant $g_m/C_L$ is maintained without significant drift and variations that might otherwise be caused by parasitic capacitances are substantially avoided. Source follower circuitry may also be provided to substantially eliminate any absolute differences between the sources of the current source devices of the bias circuit and sources of the differential pair thereby further reducing variations in $g_m/C_L$ caused by body effects.

Method and apparatus embodiments of the invention are provided.

BRIEF DESCRIPTION OF THE DRAWINGS

The features, objects, and advantages of the invention will become more apparent from the detailed description set forth below when taken in conjunction with the drawings in which like reference characters identify correspondingly throughout and wherein.

DETAILED DESCRIPTION OF THE PREFERRED EMBODIMENTS

Referring to the remaining figures, exemplary embodiments of the invention will now be described. The embodiments will primarily be described with respect to bias circuits for biasing a single-ended or differential pair CMOS operational amplifier of a SC circuit. However, principles of the invention are applicable to other operational amplifier topologies such as telescopic, folded cascode, two-stage pole-splitting, and multi-stage operational amplifiers as well as to other devices employing differential pairs. Also, a specific embodiment is described herein involving an operational amplifier with an NMSO differential pair. Aspects of the invention are also applicable to devices employing PMOS differential pairs.

Figure 1:
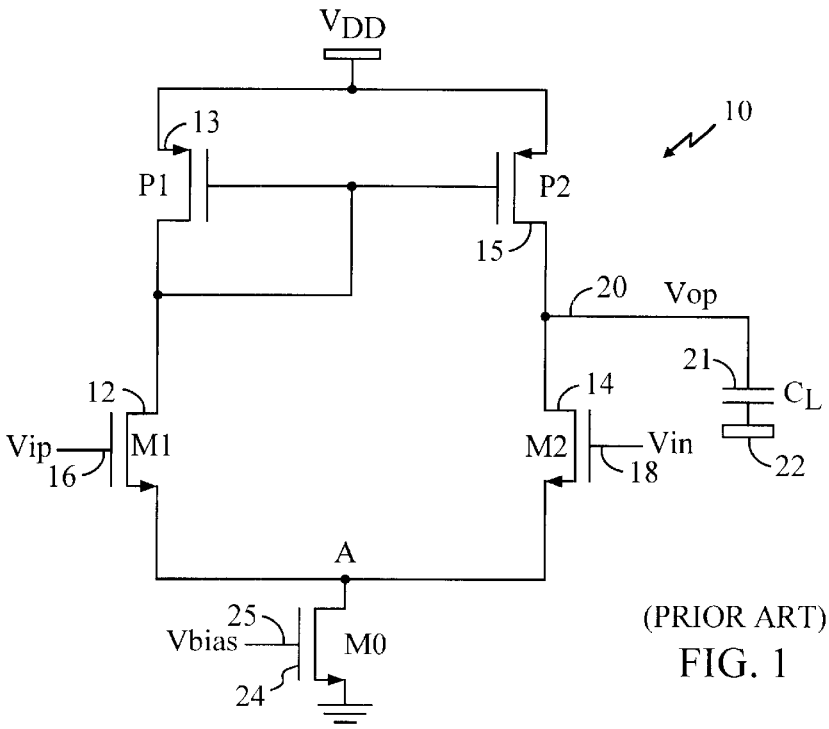
(PRIOR ART) FIG. 1
FIG. 1 illustrates a conventional operational amplifier adapted for use in an SC circuit.
Figure 2:
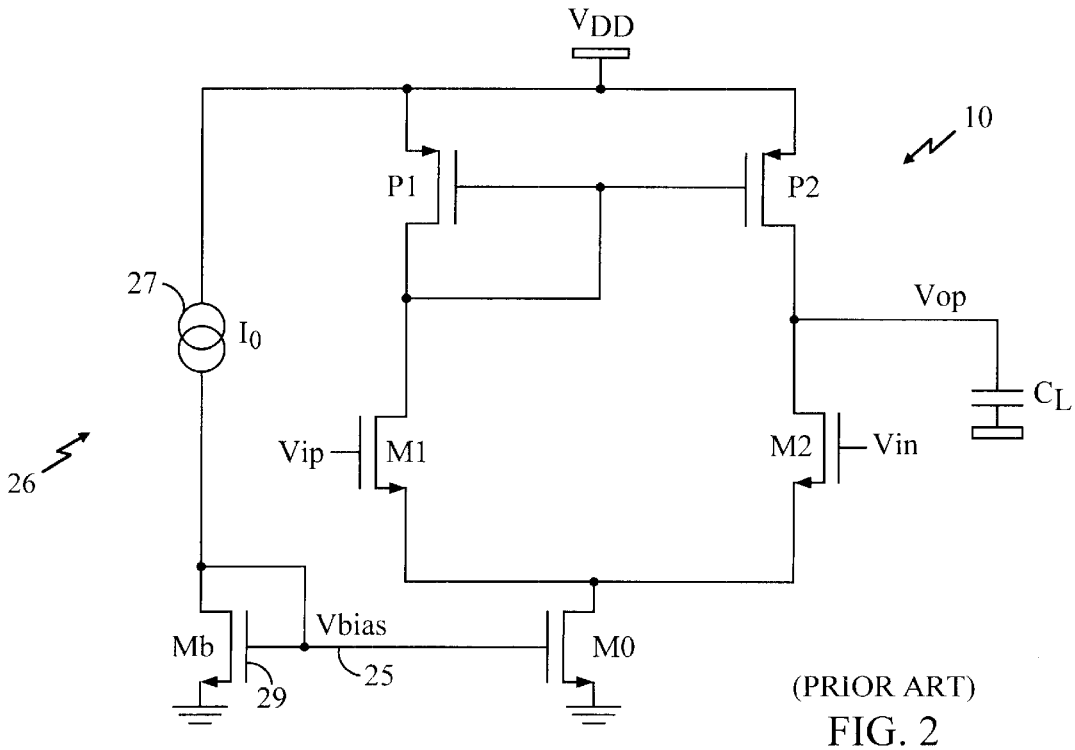
(PRIOR ART) FIG. 2
FIG. 2 illustrates the operational amplifier of FIG. 1 along with a constant current bias circuit.
Figure 3:
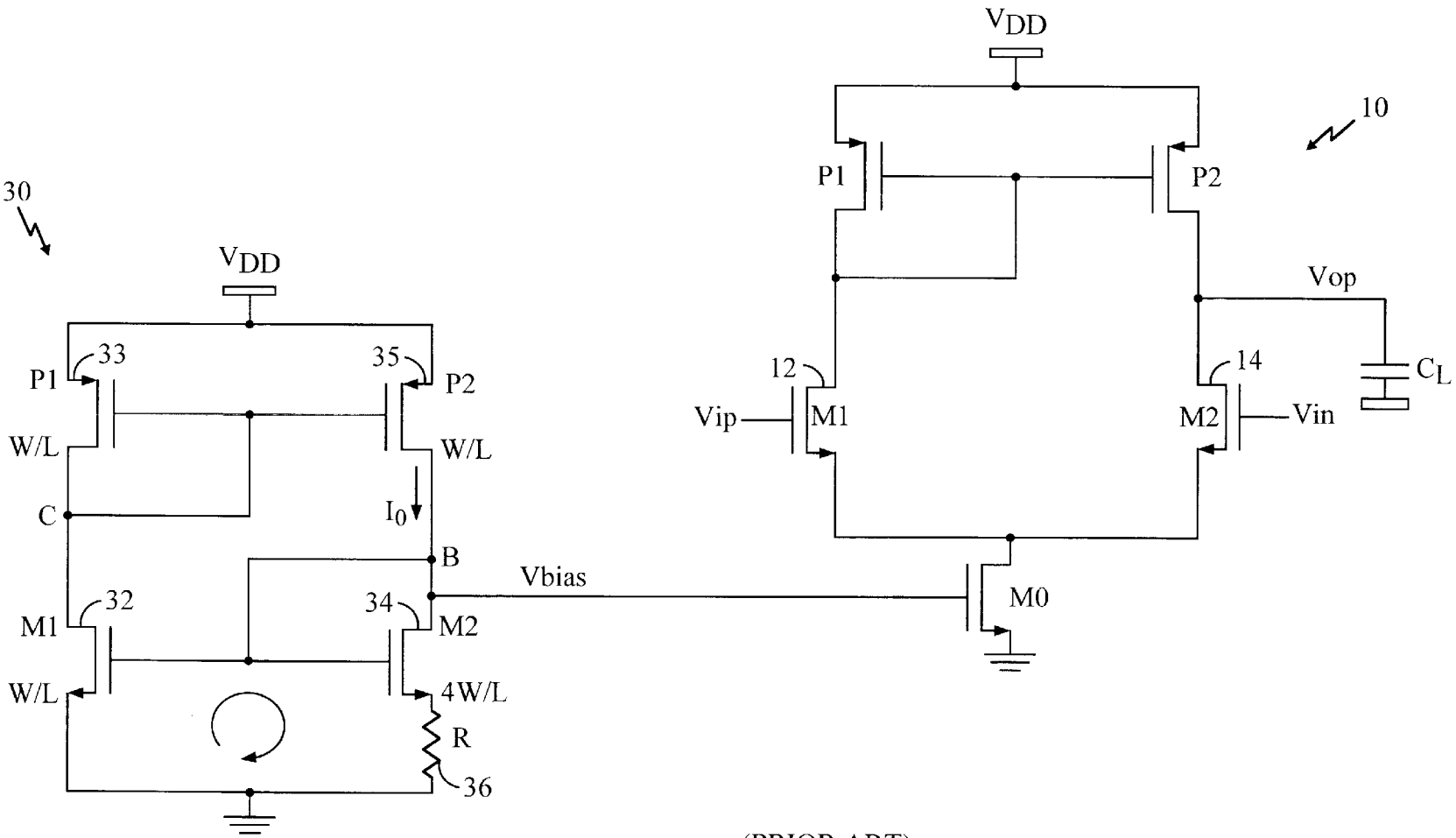
(PRIOR ART) FIG. 3
FIG. 3 illustrates the operational amplifier of FIG. 1 along with a constant $g_m$ bias circuit.
Figure 4:
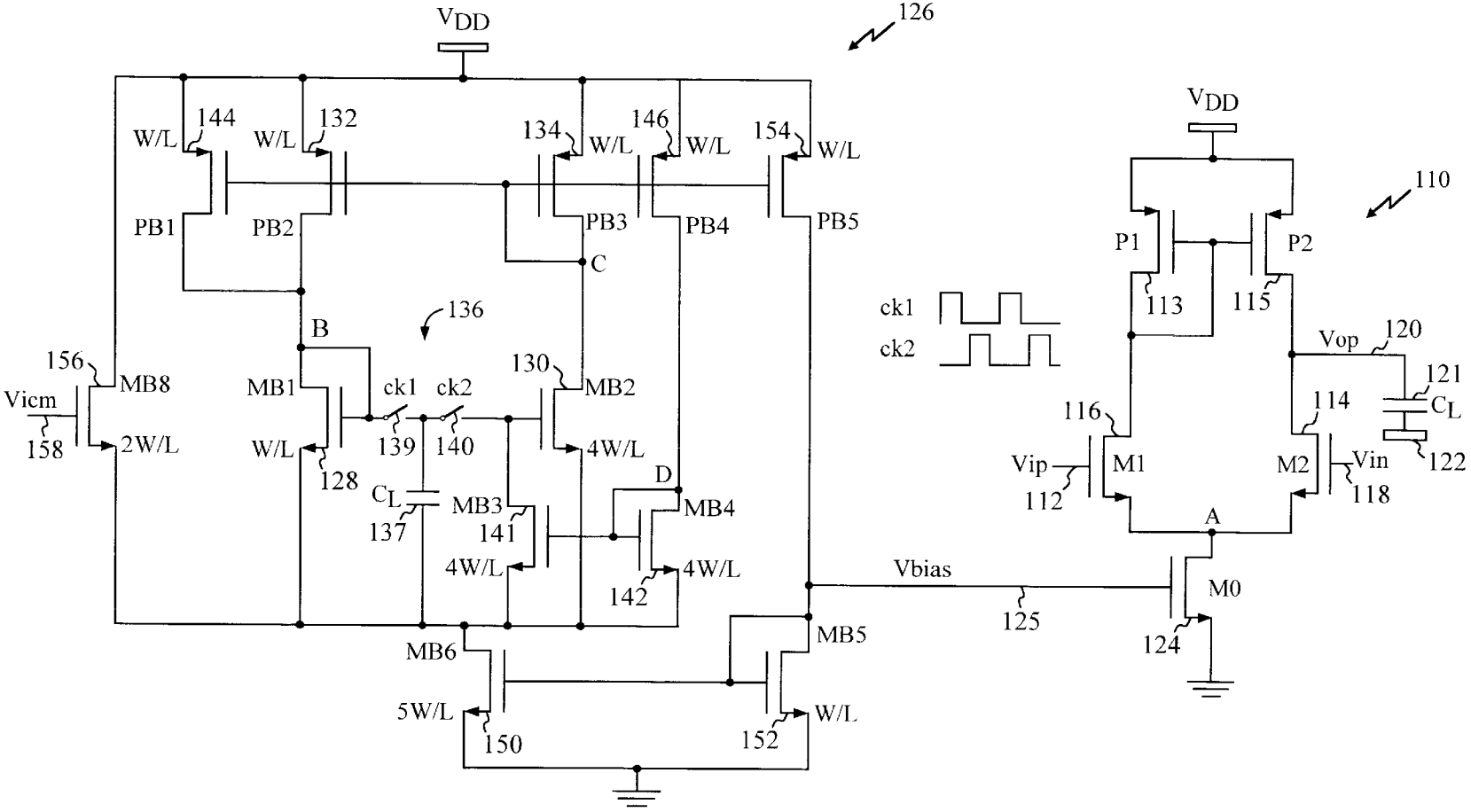
FIG. 4 illustrates an operational amplifier with a constant $g_m/C_L$ bias circuit configured in accordance with a first exemplary embodiment of the invention wherein a single resistance-equivalent circuit is employed along with a pair of non-overlapping clock signals.

FIG. 4 illustrates a constant $g_m/C_L$ bias circuit 126 for use with an operational amplifier 110 having an NMOS differential pair. Operational amplifier 110 includes a differential pair of NMOS devices 112 and 114 and a differential pair of PMOS devices 113 and 115 connected in parallel between a positive voltage source $V_{DD}$ and a node A. The pair of NMOS devices have gates connected to a pair of voltage input lines 116 and 118, respectively. An output line 120 is connected to a node interconnecting device 114 and device 115 as shown. A capacitor 120, providing an equivalent load capacitance of $C_L$, couples the output signal to an external load 121. The operational amplifier operates to amplify any voltage differences between signals received along lines 116 and 118. An output signal representative of those differences is output along output line 120. An additional NMOS device 124 is connected between sources of the differential NMOS pair and ground for receiving a bias signal to compensate for process, temperature and body effect variations while providing the constant $g_m/C_L$.

Bias circuit 126 operates as a current mirror to provide the bias signal for use by operational amplifier 110. Bias circuit 126 includes a primary pair of NMOS devices 128 and 130 connected in parallel between nodes B and C and ground. The bias circuit also includes a pair of primary PMOS devices 132 and 134 connected in parallel between nodes B and C and the positive voltage source. Gates of the primary NMOS devices are cross-coupled to node B. Gates of the primary NMOS devices are cross-coupled to node C. A resistance-equivalence circuit 136 is connected between gates of primary NMOS devices 128 and 130 as shown. The resistance-equivalent circuit includes a sampling capacitor 137 and a pair of input clock signal switches 139 and 140 providing fixed frequency non-overlapping clock sampling signals ck1 and ck2. The sampling clocks ck1 and ck2 are non-overlapping as shown in FIG. 4.

To ensure that a bias signal is generated, a voltage drop across circuit 136 is necessary. Accordingly, voltage-setting circuitry is provided within bias circuit 126. The voltage-setting circuitry includes a pair of secondary NMOS devices 141 and 142 having sources connected to ground and a pair of secondary PMOS devices 144 and 146 having sources connected to the positive voltage source. Gates of the secondary NMOS devices are connected together. Gates of the secondary PMOS devices are connected together and are connected to gates of the primary PMOS devices. A drain of secondary PMOS device 144 is connected to node B. A drain of secondary NMOS device 140 is connected to the gate of primary NMOS device 130. Drains of secondary devices 142 and 146 are connected together. Finally, the gates of secondary NMOS devices 140 and 142 are cross-coupled to a node D interconnecting the drains of devices of 142 and 146. With this configuration the various secondary NMOS devices and PMOS devices function as a current mirror for generating a voltage across the resistance equivalent circuit to thereby ensure a current through the SC resistor equivalent circuit.

Thus the bias circuit of FIG. 4 includes a resistance-equivalent circuit driven by fixed frequency sampling clock signals rather than a simple resistor as found in some conventional bias circuits. Hence, a constant $g_m/C_L$ is achieved rather than just a constant $g_m$. More specifically, the value of the equivalent resistance provided by circuit 136 is:

$$R = \frac{1}{f_s C}$$

where $f_s$ is sampling frequency of the two input clocks and C is capacitance of the sampling capacitor 137. In this circuit, at steady state, the value of $g_m$ is 1/R and hence $$g_m = \frac{1}{R} = f_s C_L,$$

or alternatively $$\frac{g_m}{C_L} = w_0 = f_s.$$

The unity gain bandwidth of the operational amplifier is thus established by the sampling clock frequency, which is typically a very stable quantity. By fixing the unity gain bandwidth, the settling time of the operational amplifier is made constant. Also, $w_0$ is fixed thus, no need for margin and extra power consumption associated with it. Both $g_m$ and the sampling capacitor $C_L$ in the bias generator are preferably chosen to be a scaled version of $g_m$ of the operational amplifier and the load respectively to save power. Also, note that the bias circuit does not require an off chip resistor or other off-chip component and can be easily made programmable by using a simple digital frequency divider.

Moreover, with the equivalent resistance developed between the gates of the primary NMOS devices rather than between one of the NMOS devices and ground, the threshold voltages for the two primary NMOS devices are therefore substantially equalized. Hence the aforementioned body effect variations which might otherwise cause variations in $g_m/C_L$ as a result of differences in threshold voltage do not occur. Thus the $g_m/C_L$ of the circuit is substantially immune to body effect variations based upon threshold voltage differences in addition to temperature and process variations.

To further reduce variations in $g_m/C_L$ due to body effects, source follower circuitry is also provided. The source follower circuitry helps reduce variations that might otherwise be caused as a result of differences between the source voltages of the primary NMOS devices of the bias circuit and the NMOS devices of the operational amplifier. The source follower circuitry includes a pair of secondary NMOS devices 150 and 152 having sources connected to ground and a single secondary PMOS device 154 connected between device 152 and the positive voltage source. The source follower circuitry additionally includes another NMOS device 156 connected, as shown, between the positive voltage source and the drain of NMOS device 150. A gate of device 156 is connected to a common mode voltage input line 158 for receiving the common mode voltage associated with the signals provided to the operational amplifier along lines 116 and 118.

With this configuration, the source follower circuitry operates to equalize source voltages of the primary NMOS devices of the bias circuitry to that of the NMOS devices of the operational amplifier. Hence, a bias current signal generated by the bias circuitry is substantially unaffected by process and temperature variations as well as body effects that may result in source voltage mismatches. A bias current line 138 interconnects the gates of secondary NMOS devices 150 and 152 to the gate of bias device 114 of the operational amplifier for coupling a bias current into the operational amplifier.

Thus FIG. 4 illustrates a bias circuit which not only provides a substantially constant $g_m/C_L$ despite process and temperature variations but also compensates for body effects as well. In one specific example, primary NMOS device 128 and primary PMOS devices 132 and 134 all have width to length ratios of W/L with primary NMOS device 130 having a width to length ratio of 4W/L. Secondary NMOS devices also have width to length ratios of 4W/L. Secondary PMOS devices have width to length ratios of W/L. Devices 152 and 154 have width to length ratios of W/L. Device 150 has a width to length ratio of 5W/L and device 156 has a width to length ratio of 2W/L.

Figure 5:
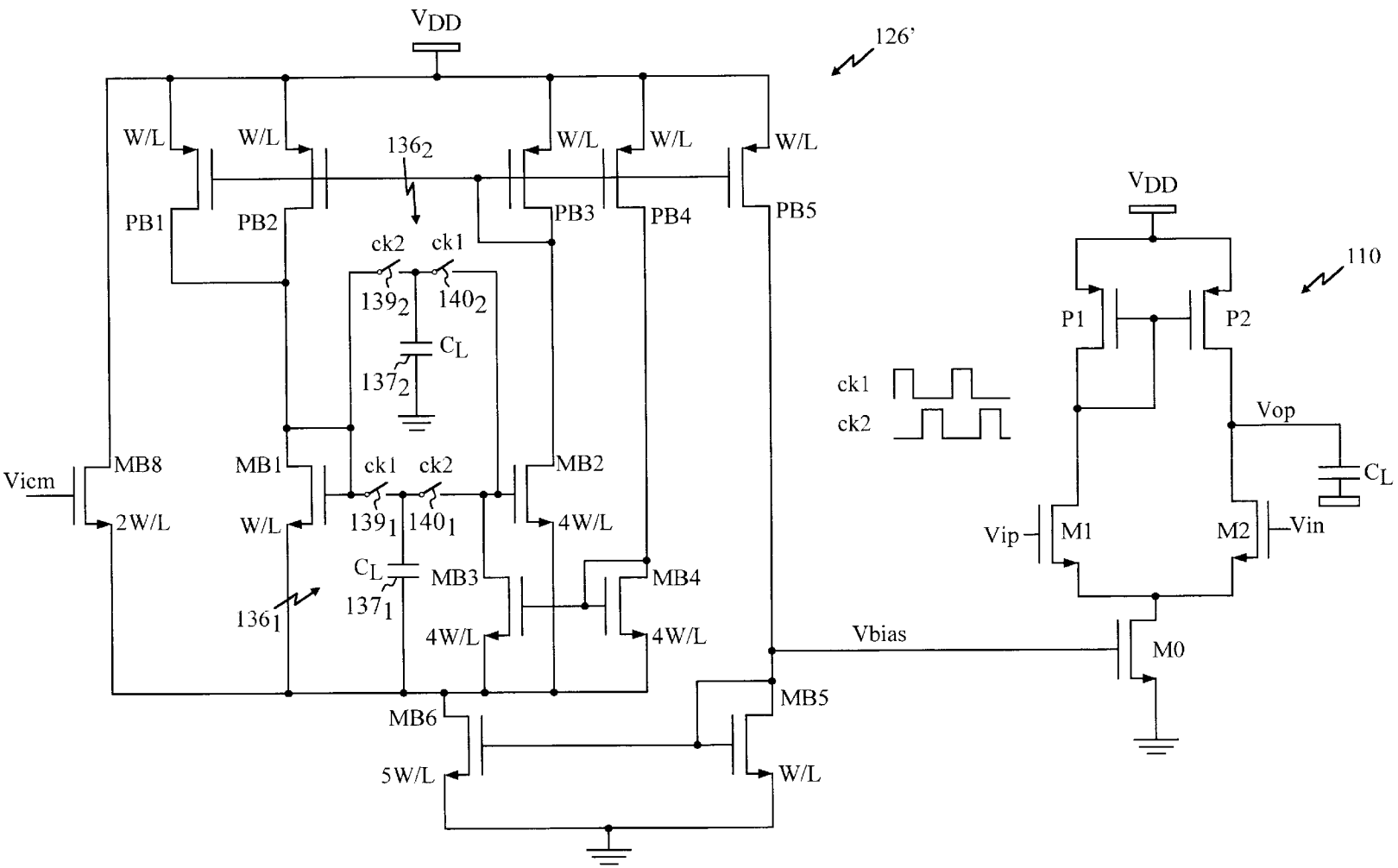
FIG. 5 illustrates an operational amplifier with a constant $g_m/C_L$ bias circuit configured in accordance with a second exemplary embodiment of the invention wherein a pair of symmetric resistance-equivalent circuits are employed along with a pair of non-overlapping clock signals.

As noted, the bias circuit of FIG. 4 includes a single resistance-equivalence circuit. FIG. 5 illustrates an alternative embodiment 126' wherein a pair of resistance-equivalent circuits are provided in parallel to help reduce parasitic capacitance effects. The bias circuit of FIG. 5 is similar to that of FIG. 4 and only pertinent differences will be described in detail.

The bias circuit of FIG. 5 includes a pair of resistance equivalent circuits $\mathbf{136}_1$ and $\mathbf{136}_2$. The resistance-equivalent circuits respectively include a sampling capacitor $\mathbf{137}_1$ and $\mathbf{137}_2$ and both have a pair of input clock signal switches $\mathbf{139}_1$ and $\mathbf{139}_2$ and $\mathbf{140}_1$ and $\mathbf{140}_2$. Input clock switches $\mathbf{139}_1$ and $\mathbf{139}_2$ receive fixed frequency non-overlapping clock sampling signals ck1 and ck2, respectively. Input clock signal switches $\mathbf{141}_1$ and $\mathbf{141}_2$ receive fixed frequency non-overlapping clock sampling signals ck2 and ck1, respectively. Thus, the bias circuit of FIG. 5 includes a pair of resistance equivalent circuits having sampling clocks ck1 and ck2 reversed from one another. With this configuration, the switching capacitor of the first resistance equivalent circuit will be loading while the switching capacitor of the other circuit is discharging and vice a versa.

Figure 6:
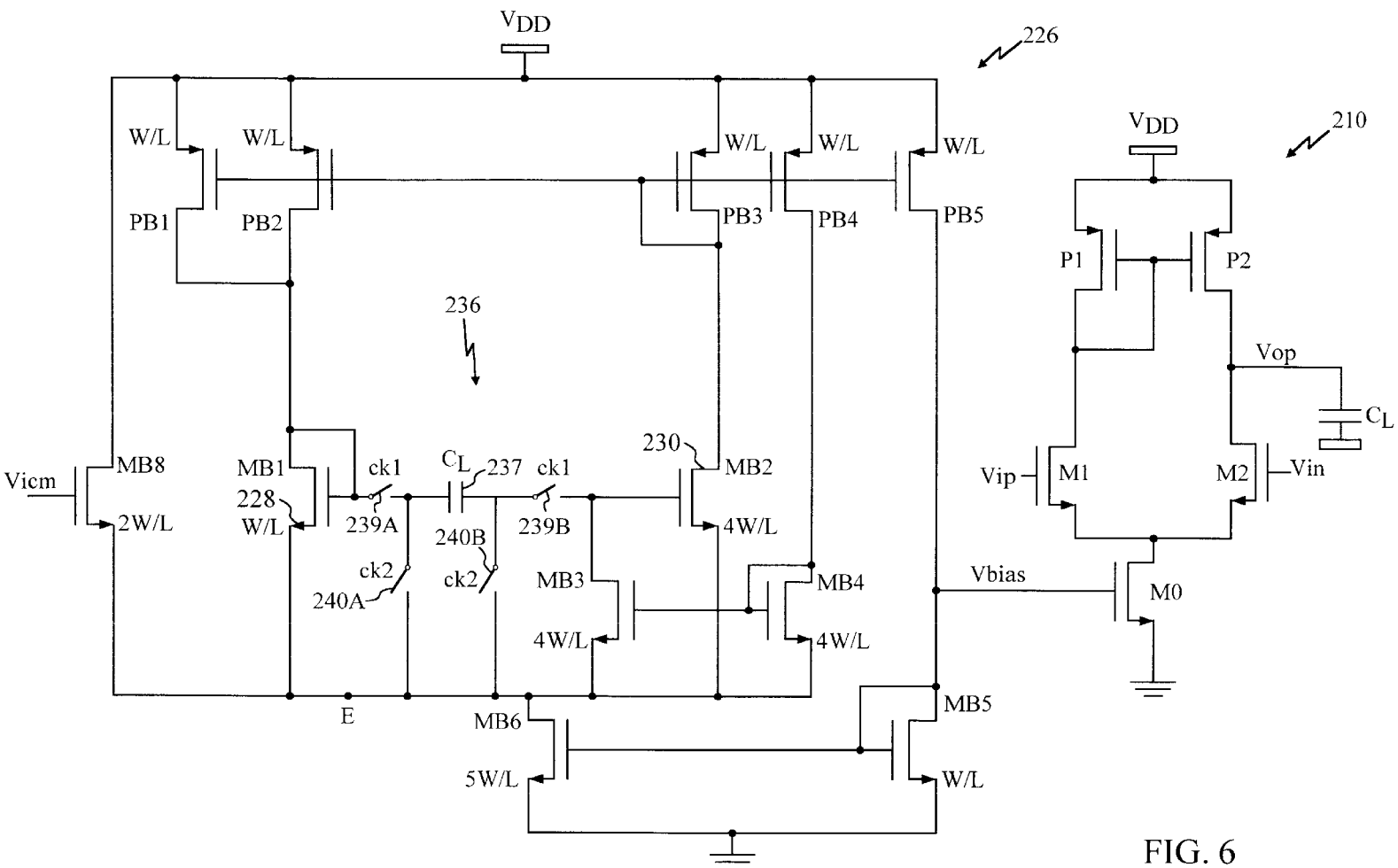
FIG. 6 illustrates an operational amplifier with a constant $g_m/C_L$ bias circuit configured in accordance with a third exemplary embodiment of the invention wherein a stray-insensitive resistance-equivalent circuit is employed along with a pair of non-overlapping clock signals.
Figure 7:
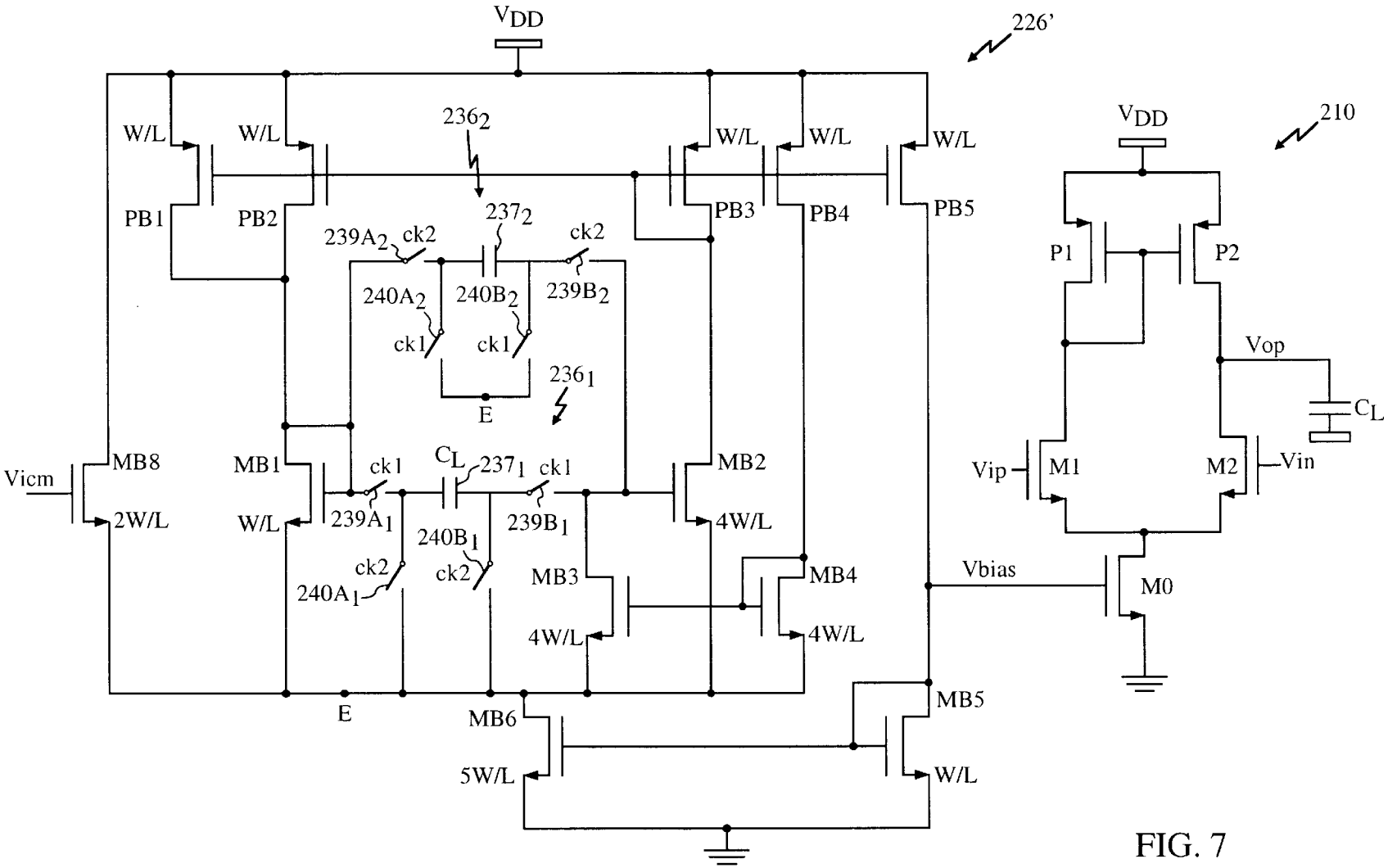
FIG. 7 illustrates an operational amplifier with a constant $g_m/C_L$ bias circuit configured in accordance with a fourth exemplary embodiment of the invention wherein a pair of symmetric stray-insensitive resistance-equivalent circuits are employed along with a pair of non-overlapping clock signals.

FIGS. 6 and 7 illustrate two embodiments of a stray insensitive bias circuit for use with operational amplifiers of SC circuits or for use with any other devices containing NMOS differential pairs. The bias circuits of FIGS. 6 and 7 are similar to those of FIGS. 4 and 5 and only pertinent differences will be described in detail. Like elements are represented using like reference numerals incremented by 100.

Stray insensitive bias circuit 226 of FIG. 6 includes a single resistance equivalent circuit 236 provided with two ck1 signal inputs and two ck2 signal inputs in combination with a single switching capacitor. More specifically, resistance equivalent circuit 236 includes a switching capacitor 237 connected between a pair of ck1 clock signal inputs 239A and 239B which are, in turn, connected to respective gates of primary NMOS devices 228 and 230. Circuit 236 additionally includes a pair of ck2 signal inputs 240A and 240B connecting opposing terminals of capacitor 237 to a node E which, as shown, is connected to sources of the primary NMOS devices.

With this configuration, while ck1 is active, switching capacitor 237 is coupled to the gates of the primary NMOS devices. However, while clock signal ck2 is active, the switching capacitor is coupled to the sources of primary-NMOS devices. Hence, a symmetric configuration is provided and variations in the clock signals will not result in any net variation in the bias signal generated by the bias circuit. Hence, the bias circuit is substantially insensitive to stray.

FIG. 7 illustrates a stay insensitive bias circuit 226' similar to that of FIG. 6 but wherein a pair of resistance equivalent circuits are provided to reduce parasitic capacitance effects. Briefly, a pair of equivalent resistance circuits $\mathbf{236}_1$ and $\mathbf{236}_2$ are connected in parallel. Equivalent resistance circuit $\mathbf{236}_1$ includes a single switched capacitor $\mathbf{237}_1$ in combination with a pair of ck1 clock input switches $\mathbf{239}A_1$ and $\mathbf{239}B_1$ and a pair of ck2 clock switches $\mathbf{240}A_1$ and $\mathbf{240}B_1$ configured as shown. Resistance equivalent circuit $\mathbf{237}_2$ includes a single switched capacitor $\mathbf{237}_2$ in combination with a pair of ck2 clock input switches $\mathbf{239}A_2$ and $\mathbf{239}B_2$ and a pair of ck1 clock input switches $\mathbf{240}A_2$ and $\mathbf{240}B_2$ configured as shown. Switches $\mathbf{239}A_1$ and $\mathbf{239}B_1$ of circuit $\mathbf{236}_1$ receive the ck1 clock signal whereas the switches $\mathbf{239}A_2$ and $\mathbf{239}B_2$ of circuit $\mathbf{236}_2$ receive the ck2 clock signals. Likewise, switches $\mathbf{240}A_1$ and $\mathbf{240}B_1$ of circuit $\mathbf{236}_1$ receive the ck2 clock signals whereas switches $\mathbf{240}A_2$ and $\mathbf{240}B_2$ of circuit $\mathbf{236}_2$ receive the ck1 clock signal.

Hence, the bias circuit of FIG. 7 provides a pair of symmetric resistance equivalent circuits having reversed clock inputs to thereby substantially eliminate any effects that might otherwise be caused by parasitic capacitance.

Figure 8:
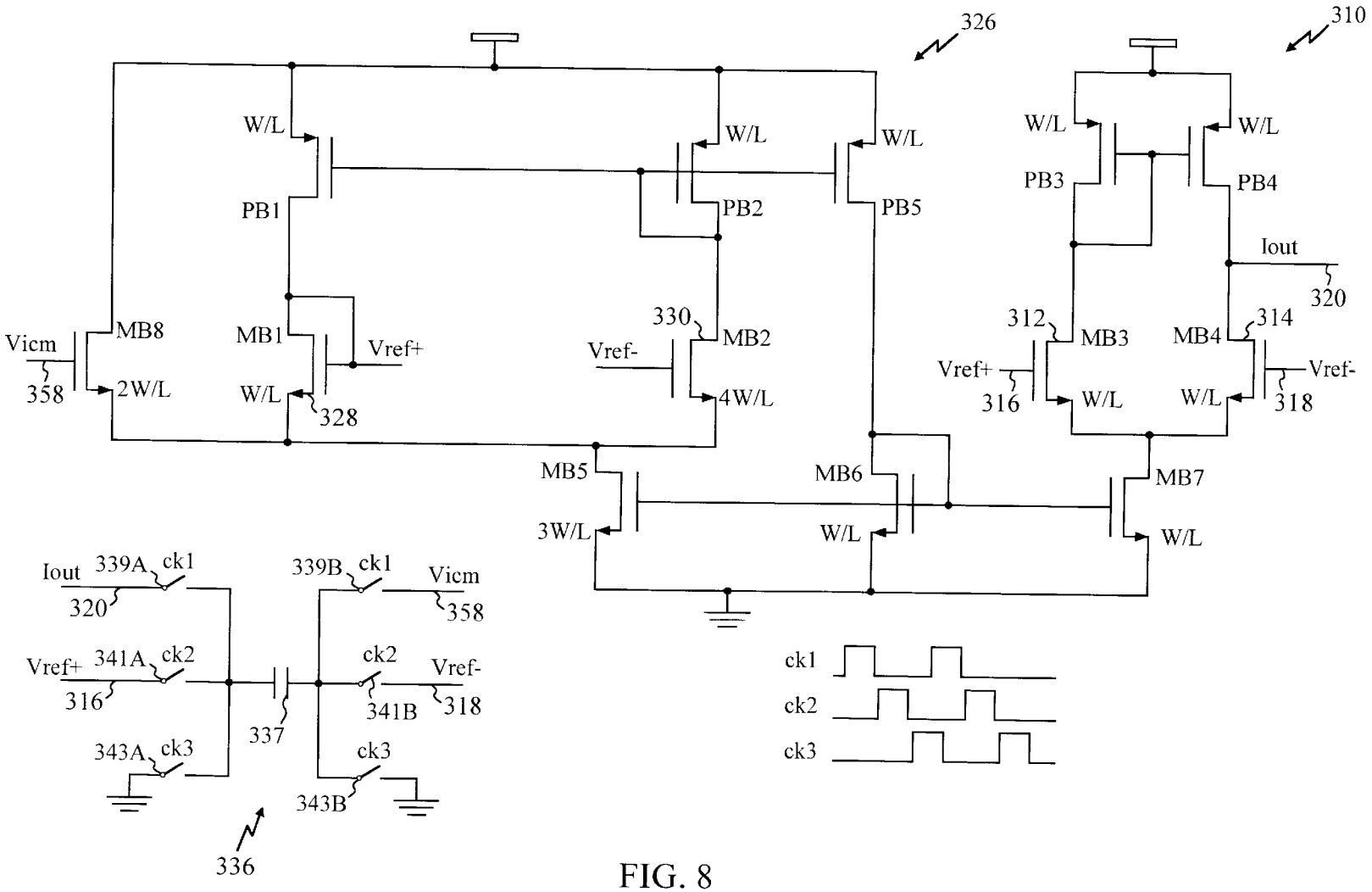
FIG. 8 illustrates an operational amplifier with a constant $g_m/C_L$ bias circuit configured in accordance with a fifth exemplary embodiment of the invention wherein a resistance-equivalent circuit is employed along with three non-overlapping clock signals.

What has thus far been described are various embodiments of constant $g_m/C_L$ bias circuits employing a pair of fixed non-overlapping input clock signals for use in switching capacitors to establish as equivalent resistance. In the following, an embodiment will be described with reference to FIG. 8 wherein three mutually non-overlapping input clock signals ck1, ck2 and ck3 are employed. The bias circuit of FIG. 8 is otherwise similar to those of FIGS. 4–7 and only pertinent differences will be described. Again, like elements are identified with like reference numerals incremented by 100.

FIG. 8 illustrates a bias circuit 326 for use with an operational amplifier 310 wherein the bias circuit includes a single resistance equivalent circuit 336 having a single switching capacitor 337. However, unlike the foregoing embodiments wherein the resistance equivalent circuit and the switching capacitor are directly coupled between the gates of the primary NMOS devices of the bias circuit, the resistance equivalent circuit of the bias circuit of FIG. 8 may be separate. More specifically, switching capacitor 337 is connected between a pair of ck1 clock signal input switches 339A and 339B, a pair of ck2 clock input switches 341A and 341B and a pair of ck3 clock input switches 343A and 343B. The output of the operational amplifier, provided along line 320, is connected to ck1 switch 339A. The common mode voltage signal input to NMOS device 358 is also connected to ck1 switch 339B. The positive voltage reference signal provided along line 336 to the operational amplifier is also connected to ck2 clock signal input 341A. The negative voltage reference signal provided along line 338 is also connected to ck2 clocks switch 341B. ck3 clock switches 343A and 343B are both connected to ground. Finally, the positive and negative voltage reference signals provided along lines 316 and 318 are also connected to the gates of primary NMOS devices 328 and 330, respectively.

With this configuration, the unity gain bandwidth operational amplifier is determined by a sampling clock frequency, a very stable quantity. Both $g_m$ and the sampling capacitor $C_L$ in the bias generator can be chosen to be a scaled version of the operational amplifier $g_m$ and the load, respectively, to save power. Thus, the foregoing analysis establishes, at least for the steady state, that constant $g_m/C_L$ is achieved. Depending upon the implementation, non-linear effects may occur before the steady state is achieved. However, these non-linear effects do not substantially influence the $g_m/C_L$ bias that is ultimately established.

Thus, various improvements have been described in constant $g_m/C_L$ bias circuits for use with operational amplifiers or other devices employing differential pairs. The improvements have been primarily described with respect to devices employing differential NMOS pairs. The improvements operate to substantially eliminate variations that might otherwise be caused by temperature changes, process variations or body effects. Other features and advantages of the circuit may be provided as well. The improvements may also be exploited within the devices employing differential PMOS pairs. In this regard, within the various circuits described above, NMOS devices may be replaced with PMOS devices and vice versa. The specific device sizes, operating voltages, and the like, however, will likely be different for a differential PMOS implementation.

The exemplary embodiments have been primarily described with reference to schematic diagrams illustrating pertinent features of the embodiments. It should be appreciated that not all components of a complete implementation of a practical system are necessarily illustrated or described in detail. Rather, only those components necessary for a thorough understanding of the invention have been illustrated and described. Actual implementations may contain more components or, depending upon the implementation, fewer components. The description of the exemplary embodiments is provided to enable any person skilled in the art to make or use the present invention. Various modifications to these embodiments will be readily apparent to those skilled in the art and the generic principles defined herein may be applied to other embodiments without the use of the inventive faculty. Thus, the invention is not intended to be limited to the embodiments shown herein but is to be accorded the widest scope consistent with the principles and novel features disclosed herein.

What is claimed is:

1. A bias circuit for use in biasing a differential pair, said bias circuit comprising:

means for generating a source current including a pair transistor devices having interconnected gates;

means for developing an equivalent resistance between the gates of said pair of transistor devices, said means for developing an equivalent resistance including means for providing capacitance and means for selectively coupling the means for providing capacitance to said gates of said pair of transistor devices at a fixed predetermined sampling frequency to establish a equivalent resistance;

means for applying a voltage across said means for developing equivalent resistance to cause said means for generating a source current to also generate a biasing current in proportion to the resistance developed by said means for developing resistance; and means for applying the biasing current to the differential pair.

2. The bias circuit of claim 1 wherein the transistor devices are NMOS devices.

3. The bias circuit of claim 2 wherein said means for generating a source current comprises:

first and second NMOS devices connected in parallel between first and second nodes, respectively, and ground; and first and second PMOS devices connected in parallel between the first and second nodes, respectively and a positive voltage source; with gates of said first and second NMOS devices connected together and further connected to the first node; and with gates of said first and second PMOS devices connected together and further connected to the second node.

4. The bias circuit of claim 3 wherein said means for developing equivalent resistance comprises:

a capacitor connected between a sampling node connecting gates of said first and second NMOS devices and a ground; and a first clock input connected between the sampling node and said gate of said first NMOS device and a second clock input connected between the sampling node and said gate of the first NMOS device; with said first and second clock inputs providing non-overlapping clock signals at the predetermined sampling frequency.

5. The bias circuit of claim 3 wherein said means for developing resistance comprises:

a first capacitor connected between a first sampling node connecting gates of said first and second NMOS devices and a ground; and a first clock input connected between the first sampling node and the gate of said first NMOS device and a second clock input connected between the first sampling node and said gate of said first NMOS device;

a second capacitor connected between a second sampling node connecting gates of said first and second NMOS devices and a ground; and a third clock input connected between the second sampling node and said gate of said first NMOS device and a fourth clock input connected between the second sampling node and said gate of said first NMOS device, with said first and second clock inputs providing non-overlapping clock signals at the predetermined sampling frequency and with said third and fourth clock inputs providing non-overlapping clock signals at the predetermined sampling frequency.

6. The bias circuit of claim 3 wherein said means for developing resistance comprises:

a capacitor connected between gates of said first and second NMOS devices; and a first clock input connected between a first terminal of said capacitor and said gate of said first NMOS device and also connected between a second terminal of said capacitor and said gate of said second NMOS device;

a second clock input connected between the first terminal of said capacitor and a ground and also connected between the second terminal of said capacitor and said ground, with said first and second clock inputs providing non-overlapping clock signals at the predetermined sampling frequency.

7. The bias circuit of claim 3 wherein said means for developing resistance comprises:

a first capacitor connected between gates of said first and second NMOS devices; and a first clock input connected between a first terminal of said first capacitor and said gate of said first NMOS device and also connected between a second terminal of said first capacitor and said gate of said second NMOS device;

a second clock input connected between the first terminal of said first capacitor and a ground and also connected between the second terminal of said first capacitor and said ground;

a second capacitor connected between gates of said first and second NMOS devices;

a third clock input connected between a first terminal of said second capacitor and said gate of said first NMOS device and also connected between a second terminal of said second capacitor and said gate of said second NMOS device;

a fourth clock input connected between the first terminal of said second capacitor and a ground and also connected between the second terminal of said second capacitor and said ground; with said first and second clock inputs providing non-overlapping clock signals at the predetermined sampling frequency and with said third and fourth clock inputs providing non-overlapping clock signals at the predetermined sampling frequency.

8. The bias circuit of claim 3 wherein said means for applying a voltage across said means for developing resistance comprises:

a third NMOS device connected between the gate of said first NMOS device and ground;

a fourth NMOS device connected between a third node and ground;

a third PMOS device connected between the first node and the positive voltage source; and a fourth PMOS device connected between the third node and the positive voltage source; with gates of the third and fourth NMOS device are connected together and further connected to the second node.

9. The bias circuit of claim 1 wherein said means for applying the biasing voltage to the differential pair comprises:

a bias line connecting sources of the pair of current source devices to the differential pair.

10. A bias circuit for use in biasing a differential pair, said bias circuit comprising:

a pair of current source devices having interconnected gates;

a resistance equivalent circuit for developing an equivalent resistance between the gates of said pair of current source devices, and resistance equivalent circuit including a sampling capacitor and switching circuitry for coupling the sampling capacitor to gates of the pair of current source devices at a fixed predetermined sampling frequency to establish the equivalent resistance;

voltage-setting circuitry connected to said resistance equivalent circuit for applying a voltage across said resistance equivalent circuit; and a bias line connecting a voltage output from the pair of current source devices to the differential pair.

11. The bias circuit of claim 10 wherein the resistance equivalent circuit comprises:

a capacitor connected between a sampling node connecting said pair of current source devices and a ground; and a first clock input connected between the sampling node and said first current source device and a second clock input connected between the sampling node and said second current source device, with said first and second clock inputs providing non-overlapping clock signals at the predetermined sampling frequency.

12. The bias circuit of claim 10 wherein said resistance equivalent circuit comprises:

a capacitor connected between gates of said first and second current source devices;

a first clock input connected between a first terminal of said capacitor and said gate of said first current source device and also connected between a second terminal of said capacitor and said gate of said second current source device;

a second clock input connected between the first terminal of said capacitor and a ground and also connected between the second terminal of said capacitor and said ground; with said first and second clock inputs providing non-overlapping clock signals at the predetermined sampling frequency.

13. The bias circuit of claim 10 wherein said pair of current source devices comprise first and second NMOS devices.

14. The bias circuit of claim 13 wherein the resistance equivalent circuit comprises:

a first capacitor connected between gates of said first and second NMOS devices; and a first clock input connected between a first terminal of said first capacitor and said gate of said first NMOS device and also connected between a second terminal of said first capacitor and said gate of said second NMOS device;

a second clock input connected between the first terminal of said first capacitor and a ground and also connected between the second terminal of said first capacitor and said ground;

a second capacitor connected between gates of said first and second NMOS devices;

a third clock input connected between a first terminal of said second capacitor and said gate of said first NMOS device and also connected between a second terminal of said second capacitor and said gate of said second NMOS device;

a fourth clock input connected between the first terminal of said second capacitor and a ground and also connected between the second terminal of said second capacitor and said ground; with said first and second clock inputs providing non-overlapping clock signals at the predetermined sampling frequency and with said third and fourth clock inputs providing non-overlapping clock signals at the predetermined sampling frequency.

15. The bias circuit of claim 13 wherein said pair of current source devices comprises first and second NMOS devices connected in parallel between first and second nodes, respectively, and ground; and wherein said bias circuit further includes first and second PMOS devices connected in parallel between the first and second nodes, respectively and a positive voltage source; with gates of said first and second NMOS devices connected together and further connected to the first node; and with gates of said first and second PMOS devices connected together and further connected to the second node.

16. The bias circuit of claim 15 wherein said voltage setting circuitry comprises:

a third NMOS device connected between the gate of said first NMOS device and ground;

a fourth NMOS device connected between a third node and ground;

a third PMOS device connected between the first node and the positive voltage source; and a fourth PMOS device connected between the third node and the positive voltage source; with gates of the third and fourth NMOS device connect together and further connected to the third node; and gates of the third and fourth PMOS devices connected together and further connected to the second node.

17. The bias circuit of claim 16 wherein said differential pair comprises:

fifth and sixth NMOS devices connected in parallel between a fourth node and a positive voltage source, with gates of the fifth and sixth NMOS devices connected to first and second input lines, respectively; and a seventh NMOS device connected between the fourth node and ground, with a gate of the seventh NMOS device connected to the bias circuit via the bias line.

18. The bias circuit of claim 15 wherein the bias line is connected to a fifth node connected between the first and second NMOS devices and ground.

19. The bias circuit of claim 13 further including source follower circuitry connected to sources of the first and second NMOS devices, wherein the source follower circuitry has a gate voltage set to input a common mode voltage of the differential pair.

20. The bias circuit of claim 19 wherein the source follower circuitry comprises:

an eight NMOS device connected between the positive voltage source and sources of the first and second NMOS devices, and having a gate connected to a common mode voltage input line;

a ninth NMOS device connected between the sources of the first and second NMOS devices and ground;

a tenth NMOS device and a fifth pull-dup device connected in series between the positive voltage source and the ground; with gates of the ninth and tenth NMOS devices connected together and also connected to a sixth node between the fifth PMOS device and the tenth NMOS device; and a drain of the ninth NMOS device connecting to sources of the third and fourth NMOS devices.

* * * * *